US008806945B2

(12) United States Patent
Tillotson et al.

(10) Patent No.: US 8,806,945 B2
(45) Date of Patent: Aug. 19, 2014

(54) METHOD AND APPARATUS FOR SHOCKWAVE ATTENUATION

(75) Inventors: Brian J. Tillotson, Kent, WA (US); Michael A. Loudiana, Maple Valley, WA (US)

(73) Assignee: The Boeing Company, Chicago, IL (US)

( * ) Notice: Subject to any disclaimer, the term of this patent is extended or adjusted under 35 U.S.C. 154(b) by 312 days.

(21) Appl. No.: 13/302,614

(22) Filed: Nov. 22, 2011

(65) Prior Publication Data

US 2013/0125656 A1 May 23, 2013

(51) Int. Cl.

| | |
|---|---|
| ***G01N 29/11*** | (2006.01) |
| ***F41H 5/007*** | (2006.01) |
| ***F42D 5/045*** | (2006.01) |
| ***F41H 11/02*** | (2006.01) |

(52) U.S. Cl.

CPC ..... *F41H 5/007* (2013.01); *F42D 5/045* (2013.01); *F41H 11/02* (2013.01)

USPC ..... 73/599; 73/527

(58) Field of Classification Search

USPC ..... 73/599; 86/50

See application file for complete search history.

(56) References Cited

U.S. PATENT DOCUMENTS

| | | | | |
|---|---|---|---|---|
| 1,195,042 | A | | 8/1916 | Leon |
| 2,405,694 | A | | 8/1946 | Nicolas |
| 2,513,279 | A | | 7/1950 | Albert |
| 3,050,707 | A | | 8/1962 | Baker et al. |
| 3,660,951 | A | | 5/1972 | Cadwell |
| 3,773,168 | A | * | 11/1973 | Meinass ..... 206/7 |
| 3,875,844 | A | | 4/1975 | Hicks |
| 3,943,870 | A | | 3/1976 | Paslay |
| 4,215,630 | A | | 8/1980 | Hagelberg et al. |
| 4,313,181 | A | | 1/1982 | Holm |
| 4,543,872 | A | | 10/1985 | Graham et al. |
| H1231 | H | | 9/1993 | Richards |
| 5,341,718 | A | | 8/1994 | Woodall et al. |
| 5,394,786 | A | | 3/1995 | Gettle et al. |
| 5,400,688 | A | | 3/1995 | Eninger et al. |
| 5,739,458 | A | | 4/1998 | Girard |
| 6,029,558 | A | | 2/2000 | Stevens et al. |
| 6,256,263 | B1 | | 7/2001 | Stevens |
| 6,266,926 | B1 | | 7/2001 | Figge et al. |
| 6,279,449 | B1 | | 8/2001 | Ladika et al. |

(Continued)

FOREIGN PATENT DOCUMENTS

| | | |
|---|---|---|
| WO | 97/16697 | 5/1997 |
| WO | 2011/148165 | 12/2011 |

OTHER PUBLICATIONS

PCT, International Search Report and Written Opinion, International Application No. PCT/US2012/061017 (Jan. 18, 2013).

U.S. Appl. No. 13/449,025, Office Action, Sep. 12, 2013.

(Continued)

*Primary Examiner* — J M Saint Surin

(74) *Attorney, Agent, or Firm* — Clifford G. Cousins

(57) ABSTRACT

A method and apparatus for attenuating a shockwave propagating through a first medium. The method may include the steps of detecting a shockwave-producing event, determining a direction and distance of the shockwave relative to a defended target, and interposing a second medium between the shockwave and a defended object. The second medium is different from the first medium and the shockwave is attenuated in energy as it passes through the second medium prior to reaching the defended object.

20 Claims, 13 Drawing Sheets

(56) References Cited

U.S. PATENT DOCUMENTS

| | | | | |
|---|---|---|---|---|
| 6,412,391 | B1 | 7/2002 | Stevens et al. | |
| 6,595,102 | B2 | 7/2003 | Stevens et al. | |
| 6,653,972 | B1 | 11/2003 | Krikorian et al. | |
| 6,782,790 | B2 | 8/2004 | Barrett | |
| 7,077,049 | B2 | 7/2006 | Shumov et al. | |
| 7,213,494 | B2 | 5/2007 | James | |
| 7,421,936 | B2 | 9/2008 | Barger et al. | |
| 7,437,987 | B1 | 10/2008 | Ohnstad et al. | |
| 7,827,900 | B2 | 11/2010 | Beach et al. | |
| 7,866,250 | B2 * | 1/2011 | Farinella et al. | 89/36.17 |
| 7,878,103 | B2 | 2/2011 | Imholt et al. | |
| 8,042,449 | B2 | 10/2011 | Farinella et al. | |
| 8,051,762 | B2 | 11/2011 | Beach et al. | |
| 8,141,470 | B1 | 3/2012 | Farinella et al. | |
| 8,151,710 | B2 | 4/2012 | Fu et al. | |
| 8,436,730 | B2 * | 5/2013 | Fischbach et al. | 340/539.13 |
| 8,437,223 | B2 * | 5/2013 | Barger et al. | 367/129 |
| 8,448,559 | B2 * | 5/2013 | Hunn et al. | 89/36.08 |
| 8,555,768 | B1 * | 10/2013 | Barker et al. | 89/36.01 |
| 2004/0107827 | A1 | 6/2004 | Edberg et al. | |
| 2007/0006723 | A1 | 1/2007 | Waddell, Jr. et al. | |
| 2007/0180983 | A1 | 8/2007 | Farinella et al. | |
| 2008/0190276 | A1 | 8/2008 | Barger et al. | |
| 2009/0114084 | A1 | 5/2009 | Thinn et al. | |
| 2009/0266226 | A1 | 10/2009 | Beach et al. | |
| 2010/0319524 | A1 | 12/2010 | Farinella et al. | |
| 2010/0319526 | A1 | 12/2010 | Imholt et al. | |
| 2011/0120294 | A1 | 5/2011 | Beach et al. | |
| 2011/0168004 | A1 | 7/2011 | Henegar | |
| 2011/0297031 | A1 | 12/2011 | Fu et al. | |
| 2012/0060677 | A1 | 3/2012 | Farinella | |

OTHER PUBLICATIONS

Notice of Allowance, U.S. Appl. No. 13/449,025 (Jan. 14, 2014).

* cited by examiner

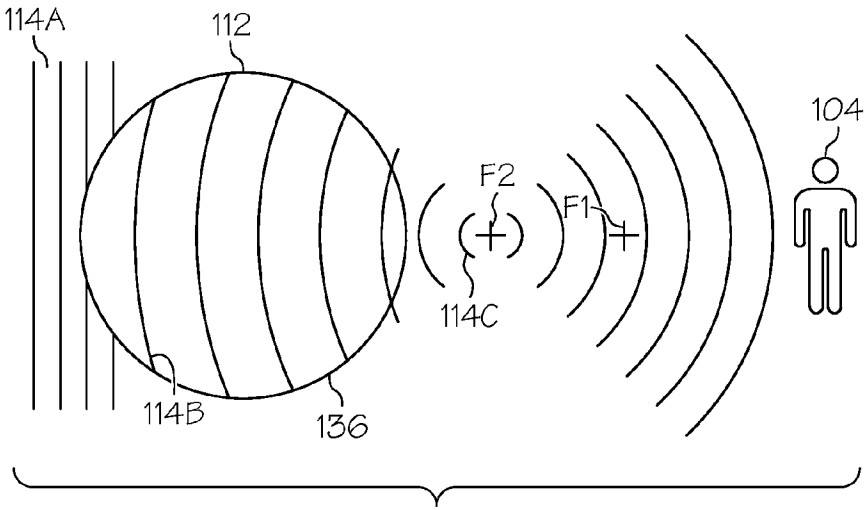
FIG. 2C2
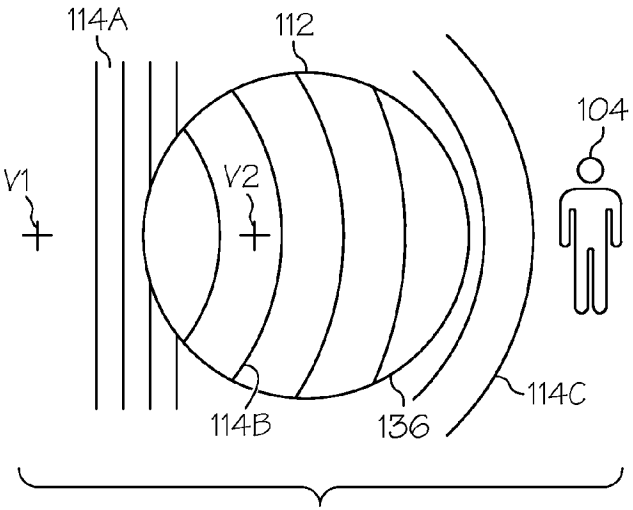
FIG. 2C1

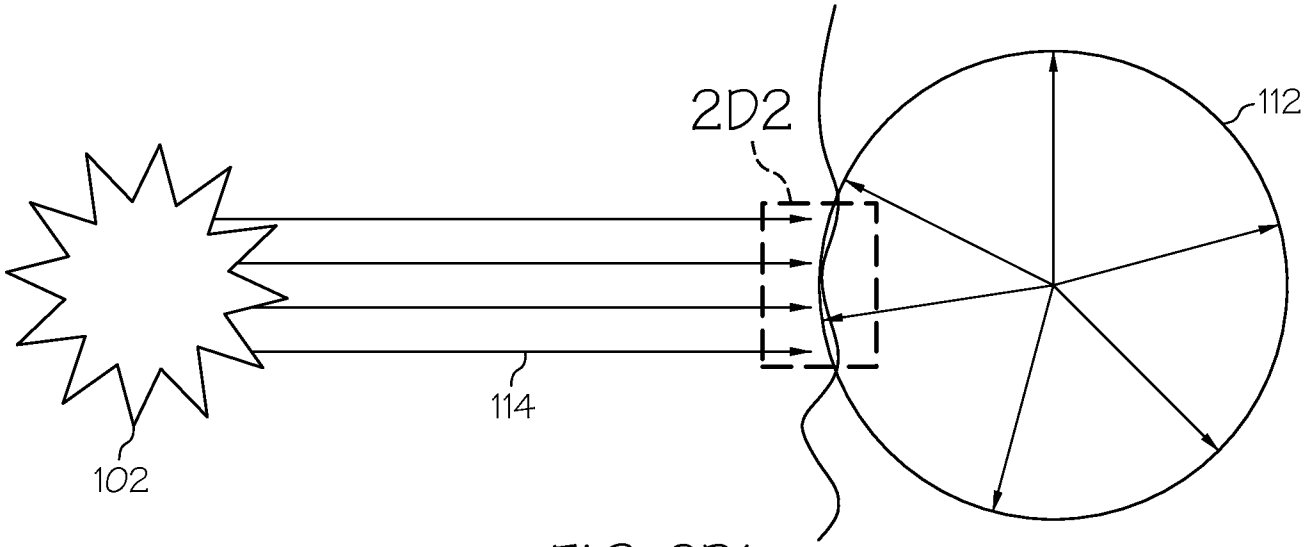
FIG. 2D1
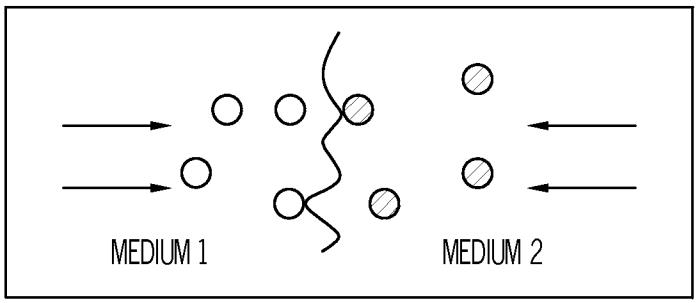
FIG. 2D2

METHOD AND APPARATUS FOR SHOCKWAVE ATTENUATION

FIELD

The disclosure relates to shockwave attenuation devices, and more particularly to a method and apparatus for interposing an intermediate medium to attenuate a shockwave.

BACKGROUND

Explosive devices are being used increasingly in asymmetric warfare to cause damage and destruction to equipment and loss of life. The majority of the damage caused by explosive devices results from shrapnel and shockwaves. Shrapnel is material, such as metal fragments, that is propelled rapidly away from the blast zone and may damage stationary structures, vehicles, or other targets. Damage from shrapnel may be prevented by, for example, physical barriers. Shockwaves are traveling discontinuities in pressure, temperature, density, and other physical qualities through a medium, such as the ambient atmosphere. Shockwave damage is more difficult to prevent because shockwaves can traverse an intermediate medium, including physical barriers.

Damage from shockwaves may be lessened or prevented by interposing an attenuating material between the shockwave source and the object to be protected. This attenuating material typically may be designed or selected to absorb the energy from the shockwave by utilizing a porous material that distorts as the energy of the shockwave that is absorbed.

U.S. Pat. No. 5,394,786 to Gettle et al. describes a shockwave attenuation device that utilizes an absorbing medium. That assembly includes porus screens that form an enclosure filled with a pressure wave attenuating medium. This attenuating medium may be an aqueous foam, gas emulsion, gel, or granular or other solid particles. However, as shown and described in the drawings of that patent, the shockwave attenuating assembly must be positioned before the explosion occurs and surround the area to be protected. For example, the assembly may be positioned on the side of a vehicle to prevent damage to the vehicle or passengers within.

A similar shockwave attenuation device is described in U.S. Patent Publication No. 2007-0006723 to Waddell, Jr. et al. That device includes a number of cells filled with an attenuating material, such as aqueous foams. However, like the device described in Gettle et al., the pressure-attenuating material and device must be positioned on a structure, surface, or person desired to be protected by the system before the explosion occurs.

One feature common among prior art shockwave attenuation systems is that they require an intermediate medium or structure that acts to attenuate the force of the shockwave by absorbing the energy of the shockwave. Although only a portion of the shockwave may pass through the medium, the energy of the shockwave is nevertheless significantly reduced by the intermediate medium. However, because these systems are structural, they must be fixed in place before a shockwave is created. Further, these shockwave attenuation systems may not protect an entire vehicle or person. For example, attenuating panels are not transparent and therefore cannot be placed over windows or used as facemasks in helmets. They also may be bulky and heavy, and therefore negatively impact the performance of a vehicle on which they are mounted.

Therefore, a need exists for a shockwave attenuation device that is capable of dynamically interposing a medium between an explosion source and a defended object. There is also a need for an intermediate medium that effectively attenuates the energy from a shockwave and that allows for complete protection of a defended object.

SUMMARY

According to one embodiment, a method for attenuating a shockwave propagating in a first medium includes, detecting a shockwave-producing event, determining a direction of said shockwave relative to a defended target or object, and interposing a second medium different from said first medium between the shockwave and the defended object such that a shockwave produced by said event passes through said second medium and is attenuated in energy thereby prior to reaching said defended target.

According to another embodiment, an apparatus for attenuating a shockwave propagating in a first medium includes a sensor for detecting a source of the shockwave, a projectile having contents adapted to form a second medium and a launcher in communication with the sensor. The launcher is adapted to launch the projectile to release the second medium between the shockwave and defended object.

According to yet another embodiment, a method for sensing and attenuating a shockwave produced by an event and propagated through a first medium includes providing a sensor for detecting the event, a launcher and a projectile. The projectile is for producing a second medium different from the first medium. The sensor senses electromagnetic indicia associated with the event and produces an output signal. This signal is transmitted to the launcher which launches the projectile in a direction to intercept the shockwave. The projectile is detonated to create the second medium, thereby causing the shockwave to be attenuated in intensity as it passes through the second medium.

The features, functions, and advantages that have been discussed can be achieved independently in various embodiments of the present invention or may be combined in yet other embodiments further details of which can be seen with reference to the following description and drawings.

BRIEF DESCRIPTION OF DRAWINGS

FIG. 2C1 is an illustration of one type of shockwave attenuation by refraction;

FIG. 2C2 is an illustration of another type of shockwave attenuation by refraction;

FIG. 2D1 is an illustration of shockwave attenuation by momentum exchange;

FIG. 2D2 is an enlarged view of section 2D2 from FIG. 2D1; and

DETAILED DESCRIPTION

The disclosed shockwave attenuation device may utilize an intermediate medium that may be dynamically deployed between an explosion and a defended object. The intermediate medium serves to attenuate the energy from a shockwave through several vectors, rather than simply absorb the energy of the shockwave.

Figure 1A:
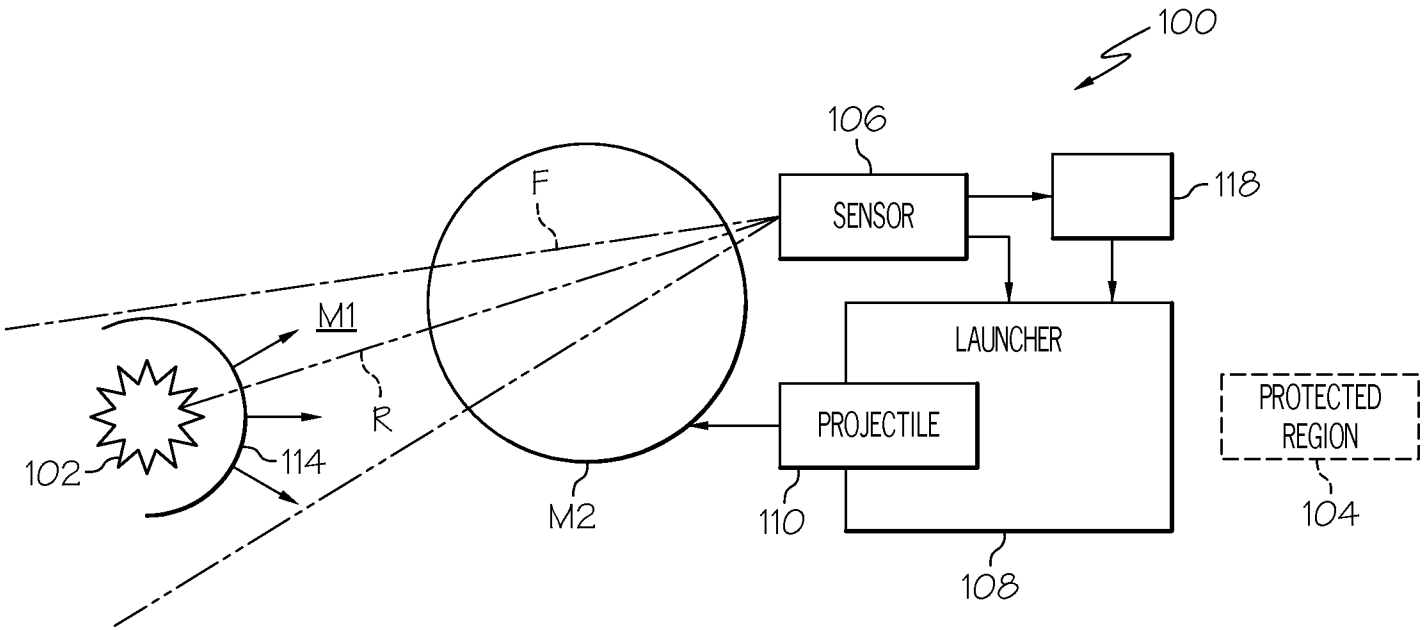
FIG. 1A is a block diagram of one aspect of the disclosed apparatus.

An apparatus, generally designated 100, for attenuating the force from a shockwave is shown in FIG. 1A. The apparatus 100 may be positioned between an explosion 102 and a protected object or region 104. The apparatus 100 may include a sensor 106, launcher 108, and projectile 110 loaded within the launcher 108.

The sensor 106 may actively monitor a field F and transmits a signal when it detects an explosion 102. The sensor 106 may have a limited viewing area so the apparatus 100 may require multiple sensors 106, each monitoring a different, discrete field F. The field F may be a field of view for an individual, stationary sensor, or may be a region scanned by a movable (mechanically or electronically) sensor.

Figure 1B:
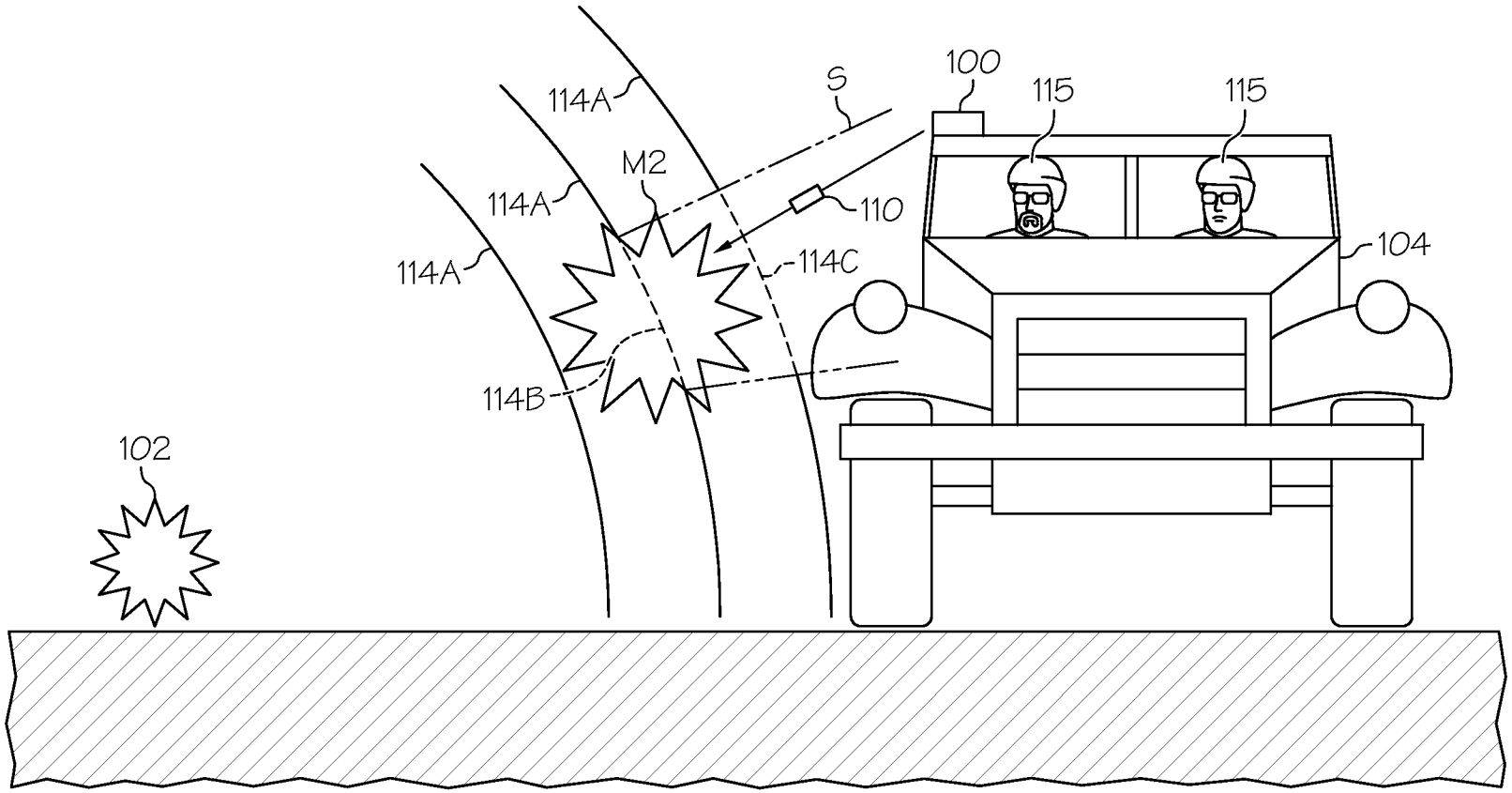
FIG. 1B is a schematic representation of the operation of apparatus of FIG. 1A when mounted on a defended object.

As shown in FIG. 1B, the defended object 104 may be, for example, a vehicle and the apparatus 100 may be mounted on the vehicle to provide shockwave attenuation, thereby protecting the occupants 115 of the vehicle.

When an explosion 102 is detected by the sensor 106, it sends a signal to the launcher 108 to fire the projectile 110 in the direction of the explosion 102 and advancing shockwave 114. The projectile 110 detonates or is otherwise activated at a target location between the shockwave 114 advancing toward the defended object 104 and releases a transient medium M2 (FIGS. 1A and 2A-D), different than the medium M1 in which the shockwave 114A travels (such as the ambient atmosphere). The medium M2 created by the projectile 110 may be a cloud of a gas, or heated air, a particulate cloud, or other deployable fluid. The projectile 110 is aimed and timed to detonate or otherwise actuate and release the medium M2 to intercept the shockwave 114 and attenuate its energy throughout a shock shadow region S (FIG. 1B) which encompasses the defended object 104. A portion of the shockwave 114B passes into and through medium M2. The energy of shockwave 114C that emerges from medium M2 is attenuated relative to the energy of shockwave 114A that enters medium M2.

Shockwaves 114 travel faster than the speed of sound (0.3 km/s in air). Certain high explosives may create strong shockwaves that travel at speeds up to 10 km/s. In contrast, electromagnetic radiation travels at the speed of light (300,000 km/s in a vacuum). The electromagnetic radiation R from an explosion—whether microwave, infrared, visible, ultraviolet, or x-ray—will reach the sensor 106 before the shockwave 114. Therefore, according to one embodiment, the sensor 106 may monitor for one or more explosion-indicating electromagnetic signals R. Alternatively, the sensor 106 may monitor for two or more of signals R in order to reduce false positives. According to one aspect, the sensor 106 may monitor for a signal R in the form of a gamma ray or neutrons, which may be released from a nuclear explosion. Indicators of an explosion that may travel slower than the shockwave 114 may not be suitable for detection by the sensor 106. However, other types of sensors are contemplated, e.g. a microwave dipole, a microbolometer, a photovoltaic detector, a scintillation crystal, a Geiger counter.

The sensor 106 is preferably configured to detect electromagnetic radiation R that is indicative of an explosion or other shockwave event. The electromagnetic radiation R is delivered in a short pulse of high magnitude radiation. The sensor 106 may therefore include an electronic filter (not shown), such as a high pass filter, that filters out ambient electromagnetic radiation.

According to one aspect, when the sensor 106 detects electromagnetic radiation R corresponding to an explosion 102, it may send a signal directly to the launcher 108. Alternatively, the sensor 106 also may be sensitive to the azimuthal angle, distance, and magnitude of the explosion 102 and may convey this information to an intermediate device 118 (FIG. 1A), such as a computer or microprocessor, that may aim the launcher 108, determine the time for detonation of a projectile 110 at a safe distance from the defended object 104, alter the quantity of media 112 that is released, control the launcher 108 and projectile 110, or otherwise analyze data from the sensor 106 and provide an output to the launcher 108.

The direction of the explosion 102 or other shockwave-producing event may be detected by a two-dimensional video sensor 106 scanning a field F. Alternatively, the sensor 106 may be configured to monitor a fixed field F and when the explosion is detected in the field F the sensor will send a positive signal. If multiple sensors 106 are used, the direction of the explosion may be determined based on the time delay between two or more sensors.

The magnitude of the explosion 102 and its travel time to the defended object 104 may be similarly calculated. The intensity and duration of the electromagnetic radiation R pulse will be indicative of the magnitude of the explosion 102, and the speed of the shockwave 114 may be calculated based on this magnitude.

The distance between the explosion 102 and defended object 104 may be calculated based on input from a single sensor. For ground-based explosions 102 the distance between the explosion 102 and defended object 104 may be determined based on the angle of elevation between the direction of the explosion 102 and the ground. For non-ground based explosions 102, the distance between the explosion 102 and defended object 104 may be determined based on electromagnetic absorption of the electromagnetic radiation R. A low-absorption electromagnetic band (e.g. green) may be monitored and provide a baseline pulse intensity. An high-absorption electromagnetic band (e.g. red) that has a high level of absorption through the air (due to ambient oxygen or other gasses) may be simultaneously monitored. The reduction in intensity of the high-absorption electromagnetic band relative to the low-absorption electromagnetic band will therefore be indicative of the distance between the explosion 102 and defended object 104. Multiple sensors could be used to calculate the distance between the explosion 102 and defended object 104 based on the position of the explosion 102 relative to each sensor 106.

The launcher 108 may be, for example, a gun that propels the projectile 110 by means of an electronically ignited propulsive charge, a compressed gas, a rail gun, an electromagnetic coil gun, or other known means. When a signal is received by the launcher 108, from either the sensor 106 or intermediate device 118, the launcher 108 may propel the projectile 110 to a position between the defended object 104 and the explosion 102 in order to intercept the shockwave 114. The launcher 108 may include multiple projectiles or include an automatic reloading mechanism (not shown), such as a magazine, drum, or other apparatus.

According to one aspect, the launcher 108 is a single-barreled gun that is in a fixed position relative to the field F monitored by sensor 106. When the sensor 106 detects electromagnetic radiation R, the sensor may transmit a signal to the launcher 108 to launch the projectile 110.

Figure 1C:
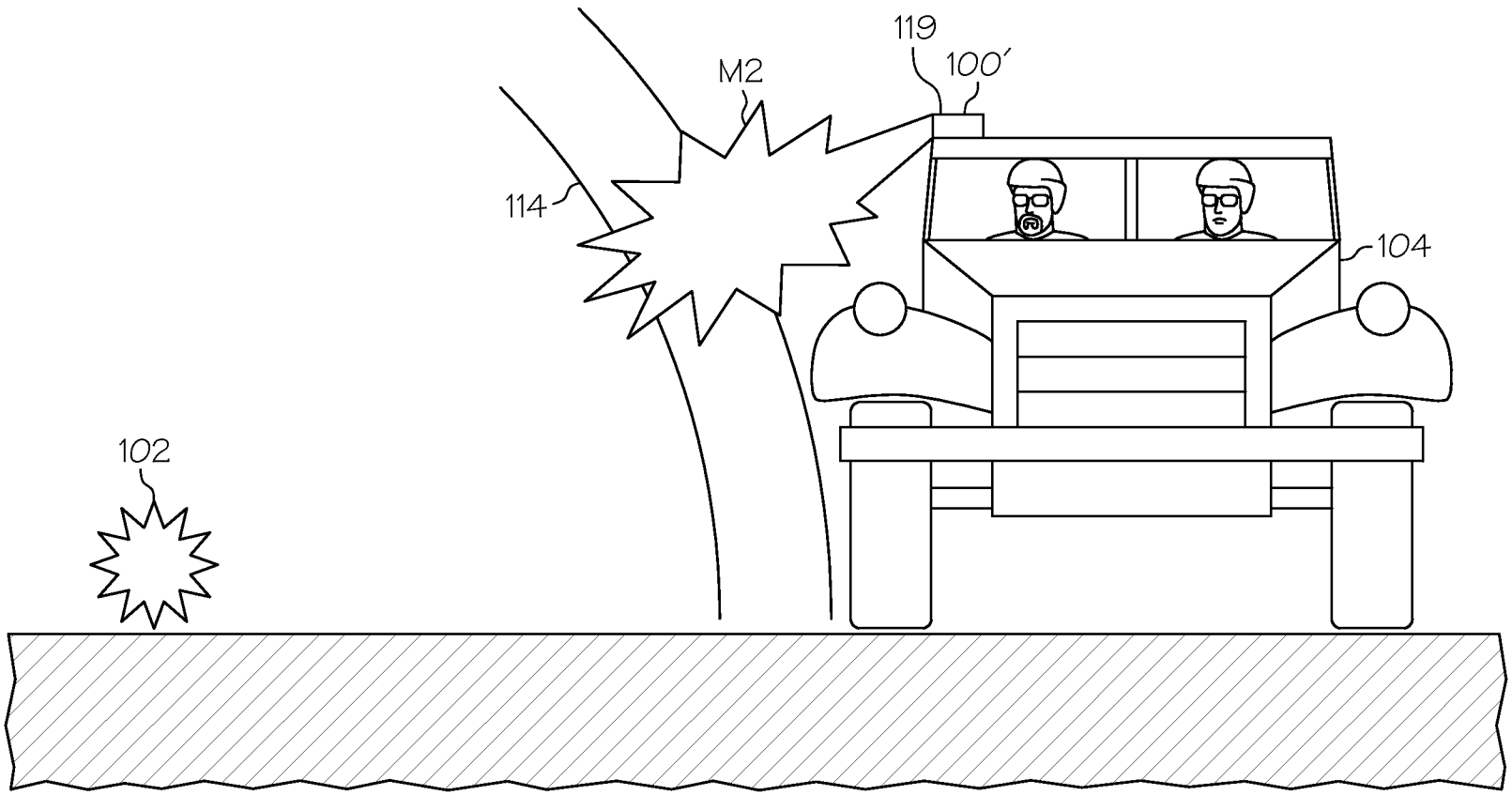
FIG. 1C is a schematic representation of an alternate embodiment of the apparatus of FIG. 1A.

FIG. 1C shows another aspect of the disclosed apparatus, generally designated 100'. The apparatus 100' lacks the launcher 108 and projectile 110 of the apparatus 100 shown in FIGS. 1A and 1B. Instead, the second medium M2 may be releasable directly from an explosion of a shaped charge 117 incorporated in the apparatus 100', when the sensor 119 detects radiation R (FIG. 1) indicative of an explosion 102.

Figure 1D:
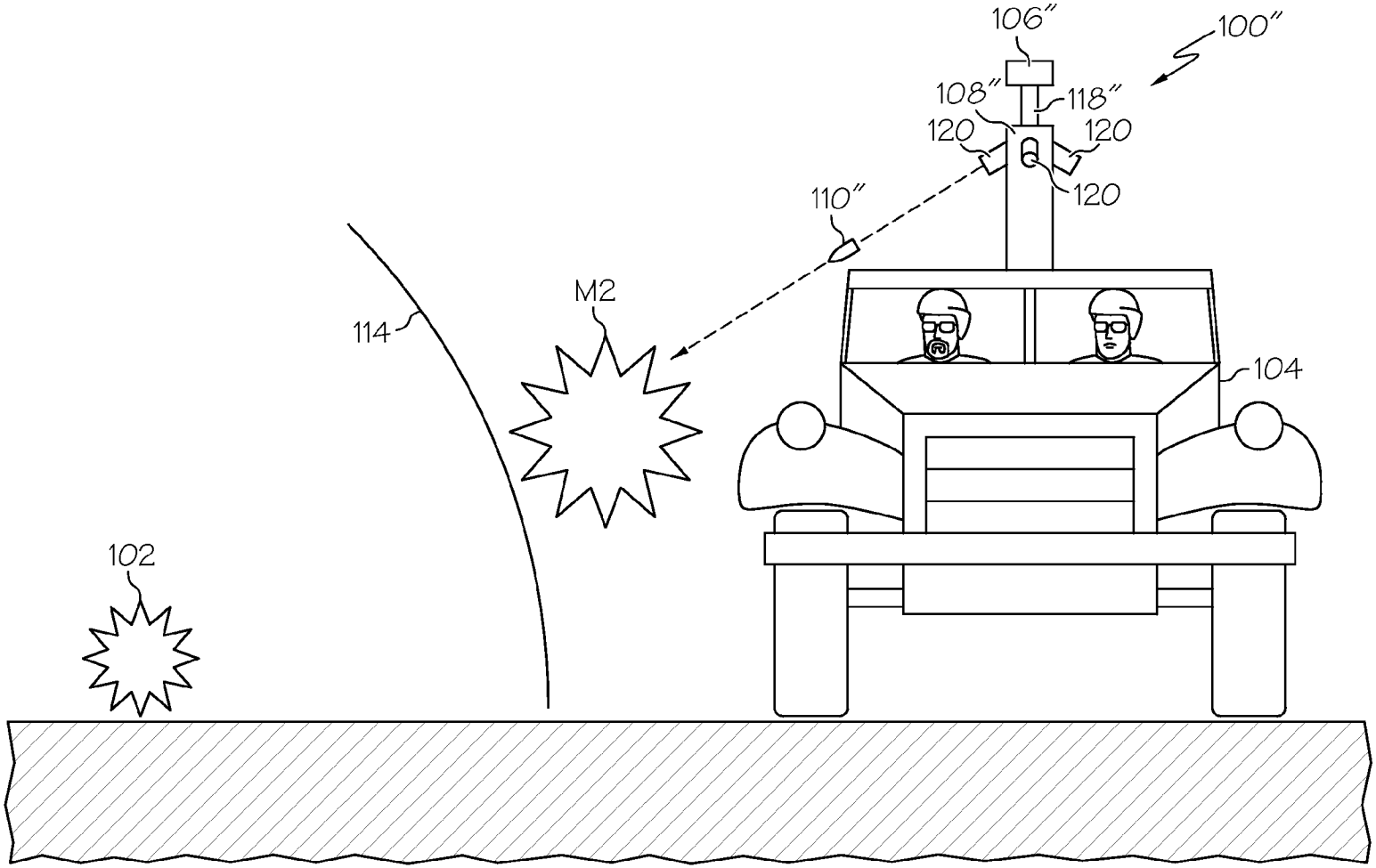
FIG. 1D is a schematic representation of a second alternate embodiment of the apparatus of FIG. 1A.

According to a further embodiment shown in FIG. 1D, the apparatus 100" may include a launcher 108" having a plurality of launch tubes 120, each arranged to point in a different direction. When electromagnetic radiation R is detected by the sensor 106", a signal may be transmitted to the intermediate device 118" that may analyze the signal to determine an azimuth angle of the explosion and select a launch tube 120 to fire a projectile 110" based on that angle. This type of launcher 108" may provide a wider azimuth range of protection, but would require additional time for the intermediate device 118" to process the signal and select a tube 120 to fire a projectile.

Figure 1E:
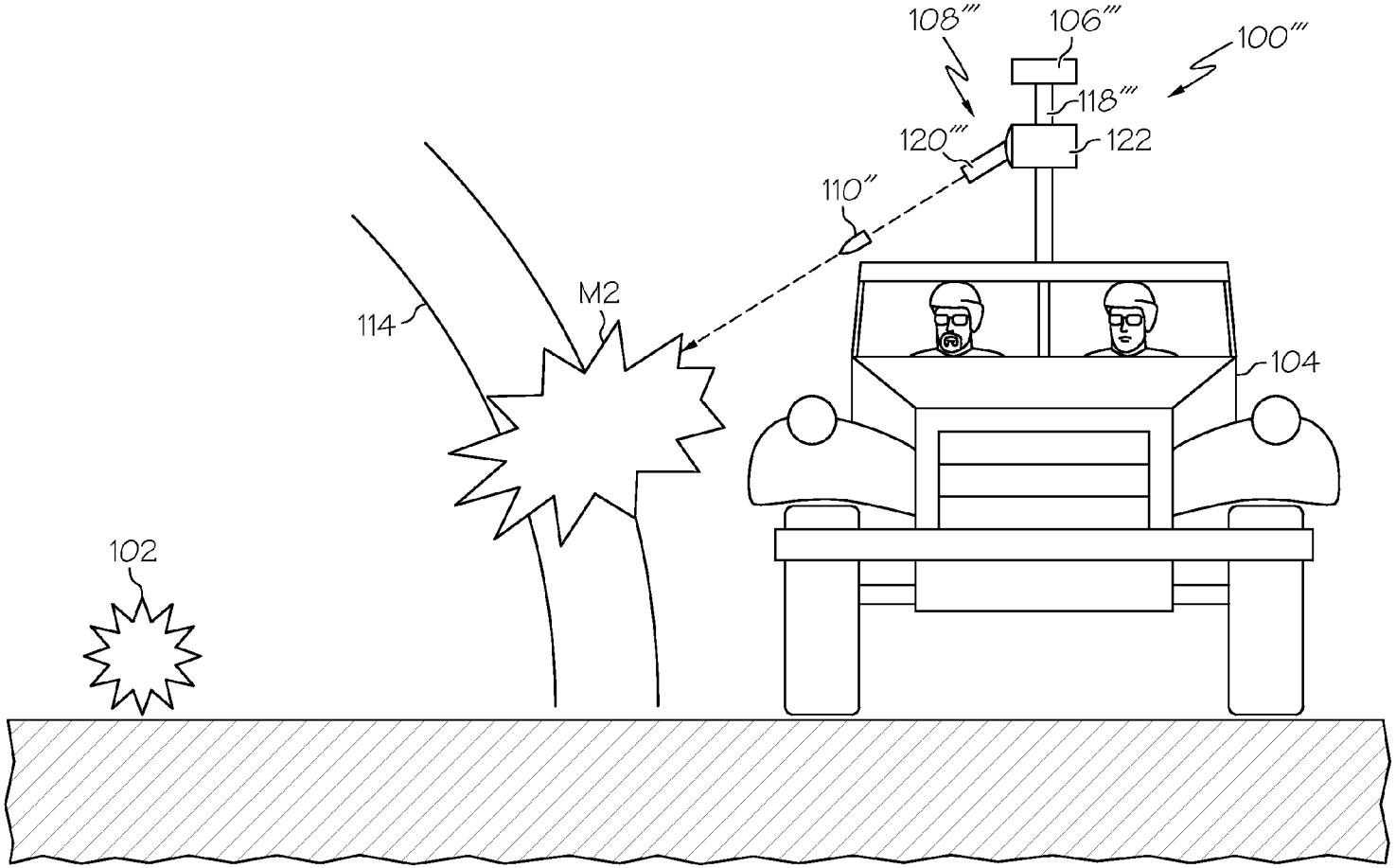
FIG. 1E is a schematic representation of a third alternate embodiment of the apparatus of FIG. 1A.

According to another embodiment shown in FIG. 1E, the apparatus 100''' may include a launcher 108''' comprised of a single launch tube 120''' mounted on a high-speed mechanical aiming mechanism 122 that includes a motor and bearing capable of adjusting the position of the gun barrel. When an explosion 102 is detected by the sensor 106''', the sensor transmits a signal to the intermediate device 118''' that may analyze the signal and determine the azimuth angle and aim the pointing mechanism 122 in a proper orientation before firing the projectile 110''' from the launch tube 120'''. This embodiment may provide an even higher potential range of protection than the multi-barrel approach depicted in FIG. 1D and require less hardware, but the response time will be slowed to process the angle, communicate this information to the pointing mechanism, and adjust the pointing mechanism as required.

Figure 1F:
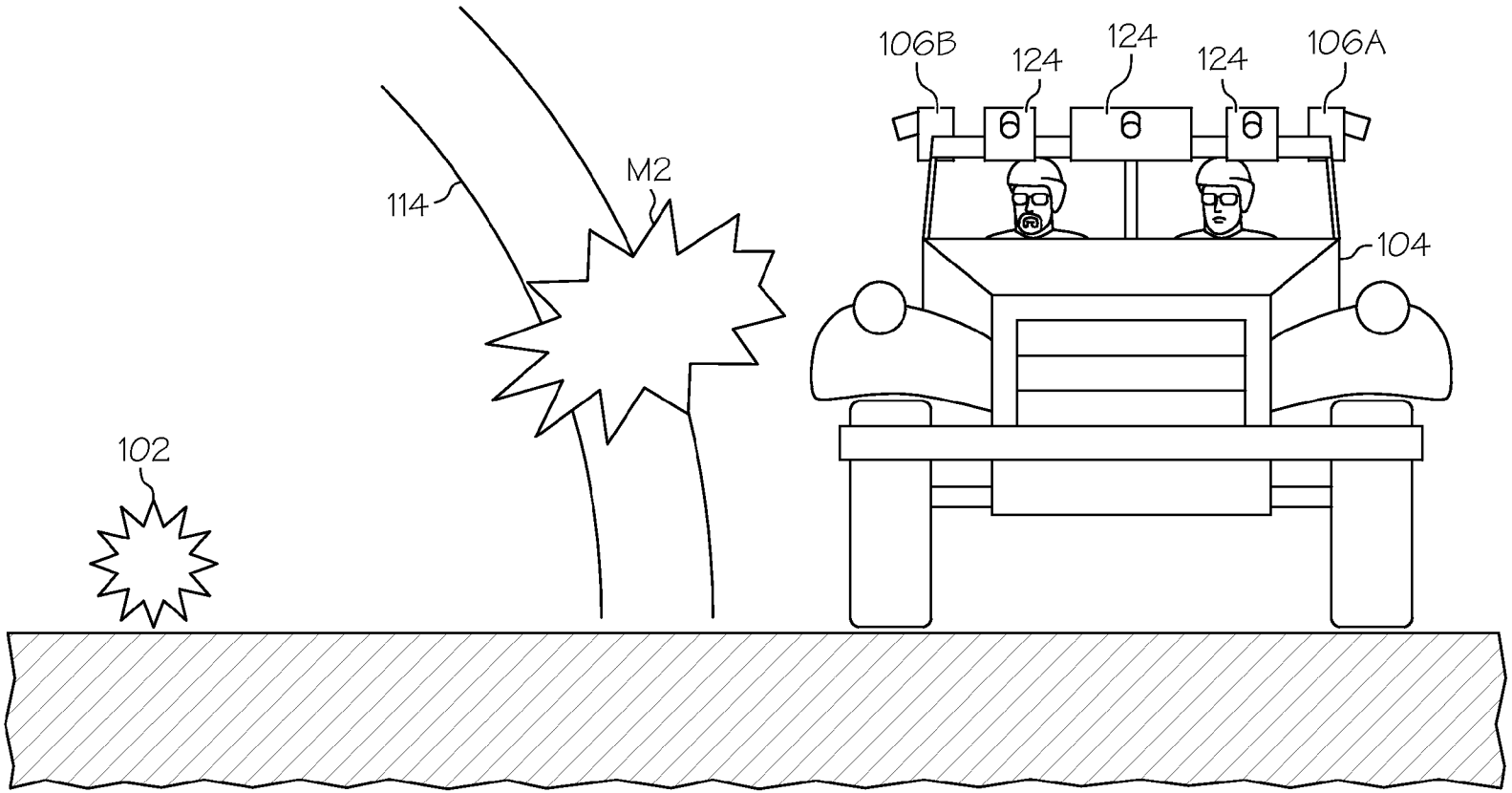
FIG. 1F is a schematic representation of a fourth alternate embodiment of the apparatus of FIG. 1A.

According to yet another embodiment shown in FIG. 1F, a number of the above-described embodiments may be positioned on a defended object 104. For example, a vehicle 104 may include a strip 124 of sensors 106 and single-barrel launchers 108, or may include strategically located sensors 106A, 106B and multiple-barrel launchers 108, each monitoring and responding to explosions in a limited field F (FIG. 1A).

The sensor may provide an estimate of the magnitude and/or distance to the explosion. The launcher may then include means for programming the projectile to activate at a predetermined distance, thereby improving shockwave attenuation.

The embodiments illustrated in FIGS. 1D-F show the launcher 108 aimed at or slightly below the horizon so that when the projectile 110 is launched it travels directly towards the interception point between the shockwave 114 and defended object 104. According to one embodiment, the projectile is detonated a few meters away from the defended object 104 and a few milliseconds after being launched.

In each of the aforementioned embodiments, the projectile 110 launched from the launcher 108 may take a variety of forms, but may be selected to interpose a medium M2 (FIG. 1A) between the defended object 104 and explosion 102 different from the medium in which the shockwave travels. The form of the projectile 110 may depend on the medium M2 that is selected to be created. The projectile 110 may be designed to release or create the medium M2 with sufficient speed and volume to intercept and substantially reduce the energy of shockwave 114. The projectile 110 may be embodied as a single object or as a plurality of projectiles, launched concurrently or in sequence, each releasing or creating a medium M2.

In one aspect, the medium M2 may be a reaction product and projectile 110 may be a shell loaded with one or more chemical reactants that produce the reaction product. This may be accomplished through, for example, burning, deflagrating, or detonating the chemical reactants within the projectile. The reaction product may be, for example, a hot gas. The chemical reactant may be, for example, TNT or hydrogen peroxide that violently decomposes to produce a reaction product that serves as the medium M2.

In another aspect, the medium M2 may be a gas and the projectile 110 may be a shell charged with the gas under pressure and include a large valve for quickly releasing the gas. In this embodiment the medium M2 may be a non-reactive gas, such as a noble gas, that may be stored at a high pressure and released into a cloud to form the medium M2.

In another aspect, the medium M2 may be suspended particulate matter, such as sand, ash, or other solid matter, suspended temporarily in the air, or a vapor of water or other liquid particles suspended in the air.

The aforementioned contents also may be combined in a projectile 110. For example, the projectile 110 may include a chemical explosive that releases its own reaction product and also heats and expels a gas. The combination of these substances may then form the medium M2 that attenuates the shockwave.

Figure 1G:
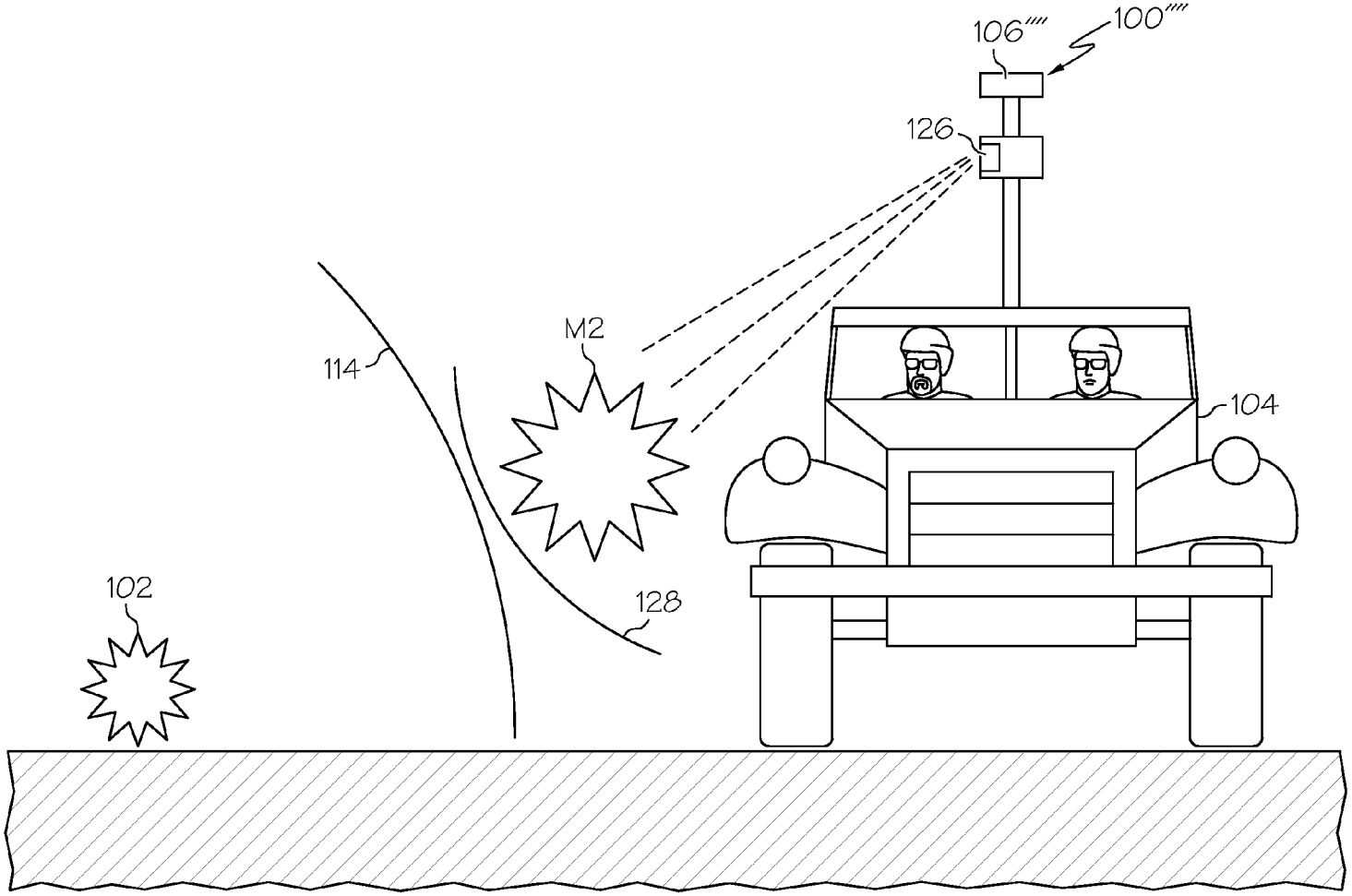
FIG. 1G is a schematic representation of a fifth alternate embodiment of the apparatus of FIG. 1A.

According to one aspect shown in FIG. 1G, the launcher 108 and projectile 110 may be eliminated. In this embodiment, the apparatus 100'''' may include a shaped explosive charge 126 that detonates upon receiving a signal from the sensor 106. The explosive charge is shaped to propel the medium M2 into the path of the shockwave 114. The medium M2 may include heated gas, particulate matter, or some other blast products. Additionally, the momentum of medium M2 traveling from the explosive charge may further mitigate the incoming shockwave 114.

Figure 1H:
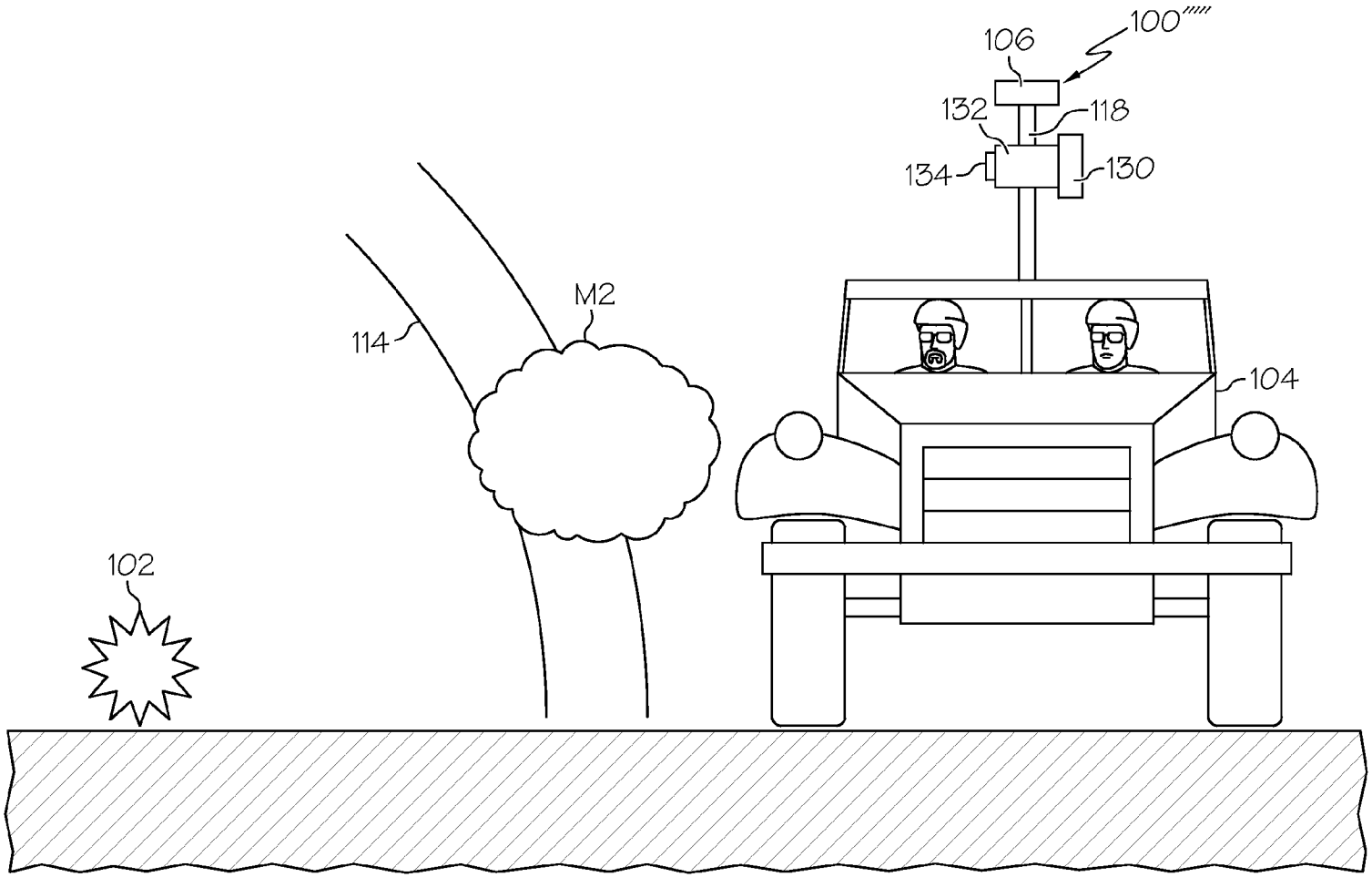
FIG. 1H is a detail schematic representation of a sixth alternate embodiment of the apparatus of FIG. 1A.

Another aspect of the combined launcher and projectile shown in FIG. 1H may be an apparatus 100''''' that includes a source 130 of pressurized gas (serving as the medium M2) that is released when a signal is received from the sensor 106. The pressurized gas may be, for example, a noble gas stored under pressure in a container and a valve is electronically controlled by the sensor 106. Alternatively, the gas may be the product of a chemical reaction as in an automotive airbag. A number of valves 132 may be provided and selectively controlled by the intermediate device 118 to expel the gas through a nozzle 134 according to an azimuthal position of the explosion 102.

Energy from a shockwave 114 that passes from a first medium M1 to a second medium M2 may be attenuated in a number of ways. First, a portion of the shockwave 114 may be reflected from the boundary between the first and second mediums M1, M2. Second, the shockwave 114 may be partially absorbed by the medium M2. Third, the shockwave 114 may be refracted by the medium M2. Fourth, the medium M2 may be travelling, thereby attenuating the shockwave 114 by means of momentum exchange.

As shown in FIGS. 2A-D, when the medium M2 has been created by one of the aforementioned mechanisms to be positioned between an explosion 102 and a defended object 104 (see also FIG. 1A), a shockwave 114 propagating through medium M1 that engages the medium M2 may, as a result, be reflected, refracted, absorbed, reduced through momentum exchange, or some combination of these.

Figure 2A:
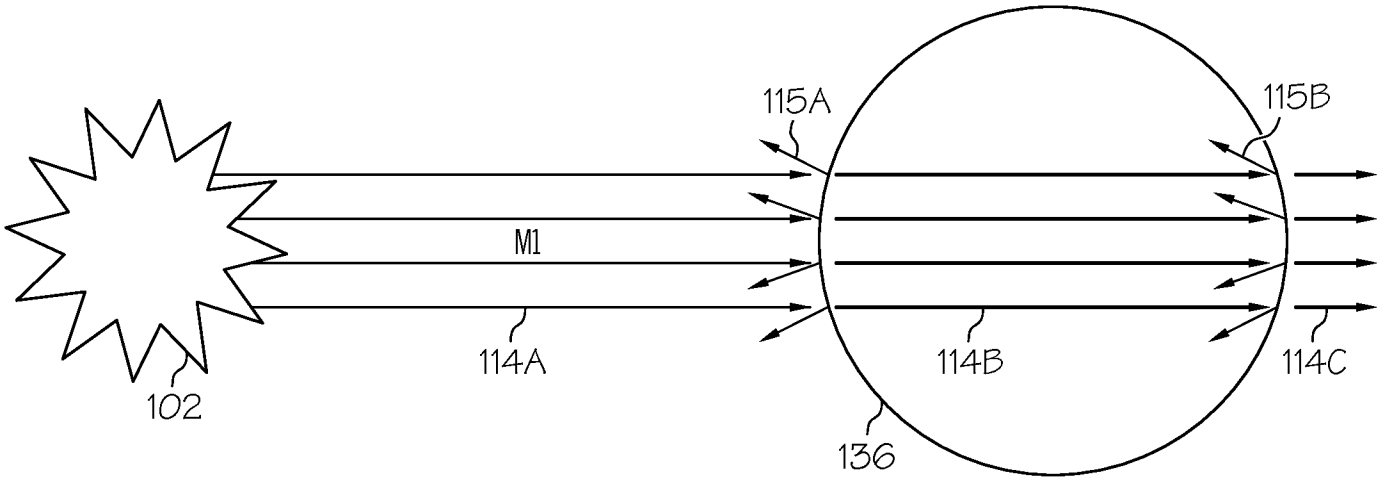
FIG. 2A is an illustration of shockwave attenuation by reflection.
Figure 3:
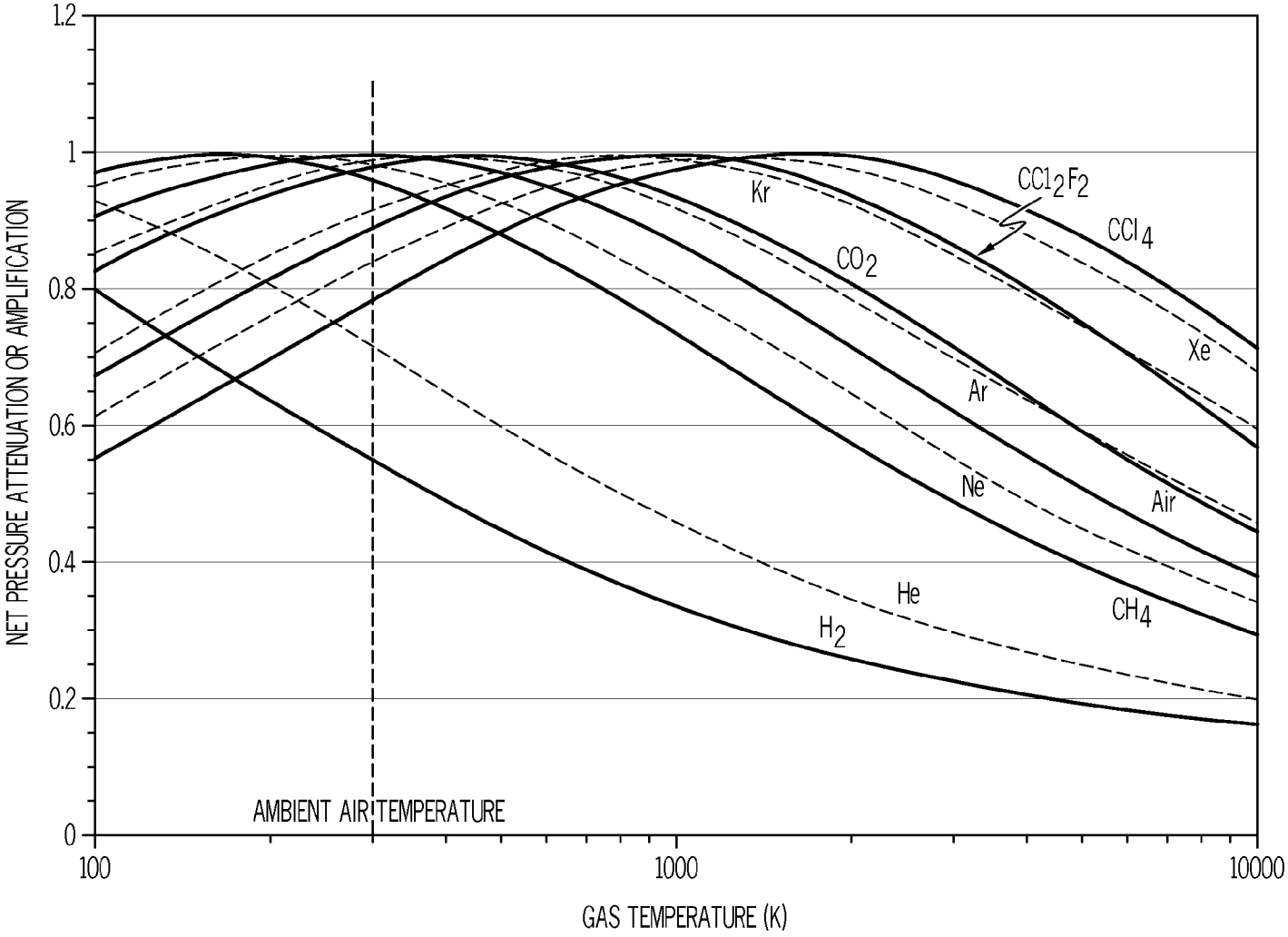
FIG. 3 is a graph showing the efficiency of various second media for shockwave attenuation by reflection.

A first mechanism for reducing the shockwave intensity is shown in FIG. 2A. When a traveling wave 114A encounters a boundary 136 between two different mediums with different shock speeds (for example, ambient air M1 and medium M2), a portion of the energy is reflected away from the boundary (indicated by arrows 115A) and a remainder 114B of the energy is transmitted through the boundary into the medium M2. After the shockwave travels through the medium M2, a portion 115B of the energy is reflected at the boundary 136. The shockwave 114C emerging from medium M2 will have been attenuated by reflection at both boundaries. Total attenuation of a shockwave by two episodes of reflection is illustrated in further detail in FIG. 3 for various media M2 as a function of gas temperature. In the figure, a value of 1 on the vertical axis indicates no attenuation. A value of 0.65, as shown for $H_2$ gas at about 1500 Kelvins, indicates a shockwave with only 65% of its initial overpressure after traversing medium M2, e.g. the shockwave has incurred 35% attenuation.

Figure 2B:
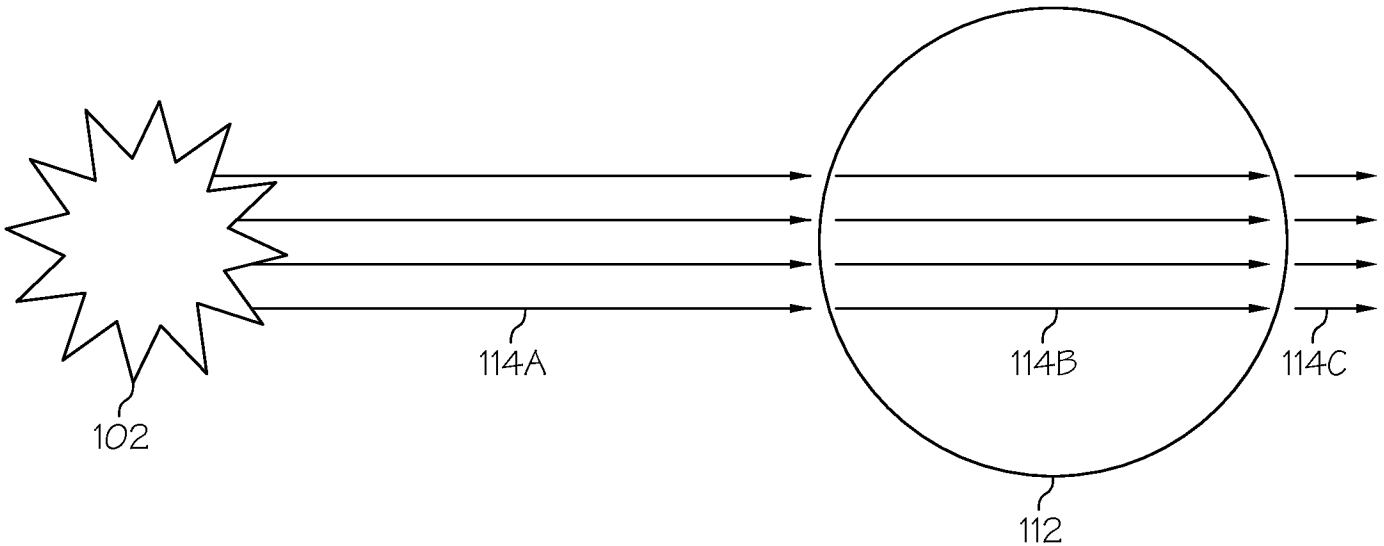
FIG. 2B is an illustration of shockwave attenuation by absorption.

A second mechanism for reducing the intensity of the shockwave is shown in FIG. 2B. The shockwave 114 enters and passes through the medium M2, a portion of the energy of the shockwave 114B is absorbed by medium M2, for example as heat energy, phase change in the medium M2, mechanical distortion of structures, pressure changes, viscous drag of particulates and other entropy-producing physical or chemical transformations of the medium M2. The shockwave 114C emerging from medium M2 will have been attenuated by this absorption of energy.

The amount of attenuation of energy of the shockwave 114 by absorption is dependent on a number of factors, including the specific heat of the medium M2, structural arrangement of the medium (for example, liquid droplets) density variations within the to medium, and other chemical and physical characteristics of the medium.

A third mechanism for reducing the intensity of the shockwave is shown in FIGS. 2C1 and 2C2. In this figure, the shockwave energy is shown as being refracted as it passes from the air into the medium M2. Shockwaves 114 in medium M1 obey Fermat's theory of least time and therefore the shockwave is refracted as it passes from one medium into the other medium M2 with a different shock speed. The refraction of the shockwave 114 may be either diverging (FIG. 2C1) or converging (FIG. 2C2).

FIG. 2C1 is an example of the medium M2 acting as a "diverging lens." Before reaching medium M2, the intensity of the shockwave 114 decreases roughly in proportion to the square of the distance from the explosion 102. As the shockwave 114 passes through the curved boundary 136 into the medium M2 where the shock speed is faster, the direction of the shockwave is distorted, causing the shockwave 114B to diverge from a virtual focal point V1. As the shockwave 114 passes through the boundary 136 back into the medium M1, the curved boundary again acts as a lens to further change the direction of the shockwave, causing the shockwave 114B to diverge even more strongly. The result is that the shockwave diverges from a virtual focal point V2. The energy of the shockwave 114 is fixed, so causing the shockwave to diverge more strongly spreads the energy of the shockwave more thinly over a larger area when it reaches defended object 104. As a result, its intensity beyond medium M2 decreases roughly in proportion to the square of the distance from the virtual focal point.

FIG. 2C2 is an example of the medium M2 acting as a "converging lens." When the shockwave 114 passes through the curved boundary 136 into the medium M2 where the shock speed is slower, the shockwave 114 is refracted to converge to a point F1. When the shockwave 114 passes the curved boundary 136 from the medium M2 back into the medium M1, the shockwave 114C is further converged towards a point F2. Once past the focal point F2, the shockwave 114C will diverge rapidly, thereby reducing the intensity of the shockwave roughly in proportion to the square of the distance past point F2 and spreading the energy of the shockwave more thinly over a larger area when it reaches defended object 104.

Whether the medium M2 forms a converging or diverging lens depends on the composition and temperature of the medium relative to the ambient; that is, M1. Cold gases having a higher molecular weight than air may tend to create converging lenses by slowing the shockwave 114 within the second medium 112. Hot gases having a lower molecular weight than air may tend to create diverging lenses as the shockwave 114 is accelerated as it passes through the second medium 112. It will be appreciated that a realistic case may include small, localized regions within the medium M2 that have faster and slower shock speeds, so the wave is generally diffused by a combination of converging and diverging lenses, not focused to a point.

As shown in FIG. 2D, comprising drawing 2D1 and the inset drawing 2D2 taken as a section of FIG. 2D1, the shockwave 114 may be reduced by means of a momentum exchange. When projected from the launcher 100, medium M2 may have a momentum toward the explosion source and opposite the direction of the shockwave. As the leading boundary 124 of the medium M2 intersects the shockwave 114, the forward momentum of the shockwave 114 will be reduced by the opposing momentum of expanding cloud of the medium M2.

According to one aspect, the medium M2 may be projected away from the defended object 104 at a velocity sufficient to give the medium M2 a velocity vector away from the defended object 104. In another aspect, the medium M2 may include particulates that have a velocity vector towards the defended object 104, but less than the velocity vector of the shockwave 114. It may be preferred that the vector field of the particulates of the medium M2 be adverse to the direction of the propagating shockwave 114.

The amount of the attenuation due to momentum exchange illustrated in FIG. 2D is dependent on a variety of factors, including the composition, temperature, speed, size, and position of the particles as they are released from the projectile.

The amount of total attenuation (particularly the amount of the shockwave 114 overpressure) may depend on the characteristics of the medium M2, including temperature, density, and composition, and on its size and its position relative to the explosion and the defended region.

While the method and forms of apparatus disclosed herein constitute preferred aspects of the disclosed shockwave attenuation apparatus and method, other methods and forms of apparatus may be employed without departing from the scope of the invention. For example, although the defended object shown in the figures is a ground vehicle, the defended region may include aircraft, ships, submarines, buildings, personnel, or other valuable assets. The number of projectiles launched to attenuate a particular explosion may be greater than one, and if greater than one, each projectile may release a medium M2 that differs in composition from the mediums M2 released by other projectiles.

What is claimed is:

1. A method for attenuating a shockwave propagating in a first medium, comprising:

detecting a shockwave-producing event;

determining a direction of a shockwave produced by said event relative to a defended object; and interposing a second medium different from said first medium between said shockwave and said defended object such that said shockwave passes through said second medium and is attenuated in energy thereby prior to reaching said defended object.

2. The method of claim 1 wherein said second medium comprises a gas.

3. The method of claim 2 wherein said gas comprises a gas that differs from said first medium in at least one of composition, density, and temperature.

4. The method of claim 3 wherein said interposing step includes delivering said gas by using at least one projectile.

5. The method of claim 4 wherein said delivering step includes opening a valve in said projectile to dissipate said gas.

6. The method of claim 1 wherein said second medium comprises a reaction product.

7. The method of claim 6 wherein said interposing step includes igniting a chemical reaction in a projectile to produce said reaction product.

8. The method of claim 7 wherein said reaction product comprises a hot gas.

9. An apparatus for attenuating a shockwave propagating in a first medium, the apparatus comprising:

a sensor for detecting an event producing said shockwave, and determining a direction of said shockwave relative to a defended object;

a projectile having contents forming a second medium, different from said first medium, when released from said projectile; and a launcher in communication with said sensor for launching said projectile to release said second medium between said shockwave and said defended object, whereby said second medium is impacted by said shockwave and thereby attenuates energy of said shockwave prior to said shockwave reaching said defended object.

10. The apparatus of claim 9 wherein said apparatus further comprises a plurality of said launchers, each of said launchers containing at least one of said projectiles therein.

11. The apparatus of claim 10 wherein said sensor includes a control for detecting an azimuthal angle of said shockwave source relative to said defended object and an output signal of said sensor contains information related to said azimuthal angle.

12. The apparatus of claim 11 wherein said apparatus further comprises an interpreter for firing one of said plurality of launchers in response to said signal of said sensor.

13. The apparatus of claim 9 wherein said sensor is adapted to detect a magnitude of said shockwave and an output of said sensor is related to said magnitude.

14. The apparatus of claim 13 wherein one of a time and a position for release of said second medium formed by said projectile is variable.

15. The apparatus of claim 14 wherein said one of the time and position for release of said second medium formed is selected in response to said magnitude of said shockwave-producing event.

16. The apparatus of claim 9 wherein said sensor is configured to detect an electromagnetic emission of said source.

17. The apparatus of claim 16 wherein said electromagnetic emission is selected from the group consisting of: visible light, x-rays, gamma rays, infrared light, ultraviolet light, radio waves and microwaves.

18. The apparatus of claim 9 wherein said sensor is configured to detect neutrons.

19. A method for sensing and attenuating a shockwave produced by an event and propagated through a first medium comprising:

providing a sensor configured to detect a component of said event, a launcher, and a projectile for producing a second medium different from said first medium;

sensing by said sensor one or more electromagnetic indicia associated with said event and producing an output signal in response thereto;

transmitting said output signal to said launcher;

launching said projectile by said launcher in a direction to intercept said shockwave; and detonating said projectile to create said second medium from said projectile, wherein said shockwave is attenuated in intensity as it passes into, through, and out of said second medium.

20. The method of claim 19 wherein said shockwave continues to attenuate after passing out of said second medium at a rate greater than the attenuation rate before said shockwave entered said second medium.

* * * * *